US005232126A

United States Patent [19]

Winer

[11] Patent Number: 5,232,126

[45] Date of Patent: Aug. 3, 1993

[54] LINER FOR DISPENSING CONTAINER

[76] Inventor: Robert Winer, 2290 Thurmont Ave., Akron, Ohio 44313

[21] Appl. No.: 829,957

[22] Filed: Feb. 3, 1992

Related U.S. Application Data

[63] Continuation-in-part of Ser. No. 646,621, Jan. 28, 1991, Pat. No. 5,111,971, which is a continuation-in-part of Ser. No. 358,392, May 26, 1989, abandoned.

[51] Int. Cl.[5] ..... B65D 34/28

[52] U.S. Cl. ..... 222/95; 222/386.5

[58] Field of Search ..... 222/386.5, 94, 95, 105, 222/131, 212, 107, 215, 183, 214

[56] References Cited

U.S. PATENT DOCUMENTS 3,731,854 5/1973 Casey .
4,387,833 6/1983 Venus, Jr. .
4,423,829 1/1984 Katz .
4,964,540 10/1990 Katz .
5,111,971 5/1992 Winer ..... 222/386.5

FOREIGN PATENT DOCUMENTS 178573 10/1985 European Pat. Off. .
63-294378 12/1988 Japan .
2153011 8/1985 United Kingdom ..... 222/105

*Primary Examiner*—Andres Kashnikow
*Assistant Examiner*—Kenneth DeRosa
*Attorney, Agent, or Firm*—Oldham, Oldham & Wilson Co.

[57] ABSTRACT

Liner for dispensing container, especially a self-pressurized container of the non-aerosol type. The liner is preferably plastic but not elastomeric, and is radially expandable and longitudinally essentially inextensible. The liner has an open end, a closed end, a sidewall extending from the open end to the closed end and a tip at the closed end. The liner has 12 to 20 side by side longitudinally extending pleats which form alternating peaks and valleys, with an acute apex angle not greater than 70° at each peak. The pleats extend through the mid-section and the lower portion of the liner. The lower portion is tapered. The liner is about 0.1 to 0.3 inches thick at the tip. The average sidewall thickness is about 0.010 to about 0.02 inch over substantially the entire length of the sidewall. The liner as formed is pleated and has memory so that it returns to the pleated state when unstressed.

6 Claims, 2 Drawing Sheets

LINER FOR DISPENSING CONTAINER

CROSS-REFERENCE TO RELATED APPLICATIONS

Applicant under 35 USC 120 and 35 USC 365(c) claims the benefit of the filing dates of earlier U.S. applications Ser. No. 07/358,392, filed May 26, 1989, now abandoned; earlier PCT International application PCT/US90/03062, filed May 25, 1990, which designates the United States; and earlier U.S. application Ser. No. 07/646,621, filed Jan. 28, 1991, now U.S. Pat. No. 5,117,971. This application is a continuation-in-part of Ser. No. 07/646,621, which in turn is a continuation in part of both earlier applications.

TECHNICAL FIELD

This invention relates to radially expandable liners for dispensing containers.

BACKGROUND ART

Aerosol containers for containing and dispensing of fluid materials are well known and widely used. Products sold in aerosol containers include, for example, foods such as whipped cream, toiletries such as shaving cream, deodorant and hair spray, and paints just to name a few. Dispensing is accomplished with the aid of propellant under pressure. Aerosol containers offer the advantage of convenience and nearly complete dispensing of the fluid product material from the container. Disadvantages of aerosol containers include limited operating temperature range, the fact that the container must be held upright to dispense properly, and increasingly, the environmental unacceptability of some of the most widely used propellants.

One of the principal classes of propellants are the fluorocarbons and chlorofluorocarbons (CFCs). The harmful effect of these materials on the ozone layer of the upper atmosphere has prompted a search for replacement. In fact, some major manufacturers of these materials have pledged to phase out their production over the next decade or so. Another class of propellants are hydrocarbons, particularly the liquified petroleum gas (LPG) hydrocarbons such as butane and pentane. While these do not tend to deplete the ozone layer (as far as is known), they do present other hazards because of their flammability.

Aerosol containers or cans fall into one of two categories as follows: (1) a standard aerosol container, wherein the product and propellant mix and (2) a barrier pack, wherein the product and the propellant are kept separated. The barrier type of aerosol container utilizes a radially expandable liner of flexible material as the barrier between material to be dispensed (which is inside the liner) and the propellant (which surrounds the liner). A representative liner of the barrier pack type is shown and described in U.S. Pat. No. 3,731,854 to Casey. One of the concerns that exists with the barrier pack container is that propellant is locked into the container after the product has been expelled, creating a hazard upon incineration of the container.

Self-pressurized containers have been suggested as an alternative to aerosol containers. Representative self-pressurized containers include those shown and described in U.S. Pat. Nos. 4,387,833 to Venus, Jr. and 4,423,829 to Katz. These references, which are rather similar in their teachings, describe apparatus for containing and dispensing of fluids under pressure in which no propellant is used and in which the fluid material to be dispensed is contained in a flexible plastic liner, which in turn is contained in (from the inside out) a fabric sleeve and an elastomeric sleeve, which surround the liner except for a small neck portion at the top. The liner, except for the neck portion and the closed bottom end, has a plurality of longitudinally extending depressions and ridges in alternating sequence so the liner in horizontal cross-section has a star like pattern. The liner wall configuration, from one depression to the next, comprises two parallel wall portions joined together by a semicircular ridge, as shown in FIG. 6 of the Katz '829 patent and FIG. 9 of the Venus patent. Both patentees disclose that the flexible liner is formed (e.g., by blow molding) in a smooth, essentially cylindrical configuration after which the folds or creases are formed. When the liner is filled under pressure with the desired product, the entire assembly expands radially. The elastomeric sleeve stores energy as a result of its radial expansion. This stored energy in the sleeve causes fluid to be dispensed upon opening of the dispensing valve. The container assembly contracts radially and the liner becomes folded, as it is emptied. Since the preferred plastic materials have memory, the liner seeks to return to the shape in which it is formed and resists becoming completely folded, which is essential to substantially complete expulsion of the product.

U.S. Pat. No. 4,964,540 to Katz discloses a liner of generally cylindrical shape, comprising a neck portion and a pleated portion which extends from the bottom of the neck portion to the closed bottom end of the liner. This pleated portion comprises a plurality of longitudinal or axial pleats characterized by alternating crests and troughs or valleys. A thin, resilient coating, of rubber-like latex material, is applied to the exterior surface of the liner and forms beads or ribs which fill the bottoms of the pleat valleys. According to patentee these ribs or valleys force the liner to regain its pleated shape in a smooth, orderly fashion as the fluid material is dispensed. Also, the latex coating has a relatively non-slip surface so that frictional forces develop between the liner and the elastomeric energy tube or sleeve which surrounds its, preventing axial slippage. This also makes more difficult the task of inserting the liner into an elastomeric sleeve during assembly.

Japanese published patent application publication number 63-294378, published Dec. 1, 1988, illustrates another liner for a dispensing container. The cross-sectional shape of the liner is generally similar to the cross-sectional shape of the liner shown in the Katz '829 and Venus patents.

DISCLOSURE OF THE INVENTION

This invention relates to an improved liner which is particularly suitable for non-aerosol dispensing containers but also usable in aerosol containers of the barrier type, and which is capable of efficient and substantially complete dispensing of fluid material and which can be reused.

This invention provides a radially expandable and longitudinally essentially inextensible flexible liner which has an open end (the upper end) a closed end (the lower end), and a sidewall extending from the open end to the closed end. The liner comprises upper sidewall means (or an upper end portion) and a regularly convoluted or pleated main portion which includes V-shaped pleats extending from the bottom of the upper sidewall means to the closed bottom end of the liner. The greater part of this pleated portion is preferably cylindrical, and the bottom part is tapered inwardly and downwardly in smooth curves from the cylindrical part to a tip of relatively small diameter at the closed end. The thickness of the upper sidewall means is essentially uniform, and is in a range of about 0.010 inch to about 0.020 inch. The average thickness of the convoluted or pleated portion of the liner is also essentially uniform, from about 0.010 inch to about 0.020 inch over substantially the entire length of the convoluted portion, except optionally at the bottom or tip end. The liner is formed in the pleated or folded state of an elastic but preferably non-elastomeric material which has memory. Substantially complete discharge of fluid material to be dispensed is aided by the fact that the liner is formed in the pleated or folded state.

BEST MODE FOR CARRYING OUT THE INVENTION

This invention will now be described in detail with particular reference to the best mode and preferred embodiment thereof.

Figure 1:
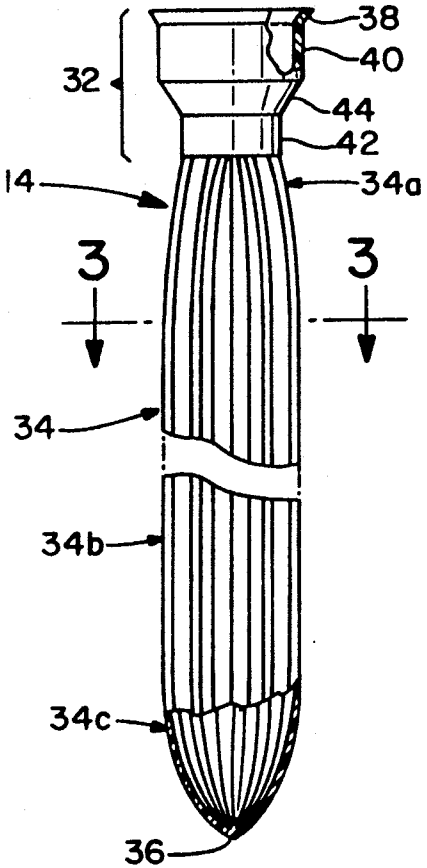
FIG. 1 is an elevational view, with parts shown in longitudinal section, of a liner according to this invention in its normal or pleated state.

The liner 14 of this invention will now be described in detail with particular reference to FIGS. 1–4. Referring now to FIG. 1, liner 14 is a elongated, generally cylindrical, radially expandable but longitudinally inextensible, flexible plastic liner having an open end (its upper end) and a closed end (the lower end), and a sidewall extending from the open end to the closed end. Liner 14 has upper sidewall means (or upper portion) 32 adjacent to the open end, and an elongated, regularly convoluted portion which extends from the bottom of the upper sidewall means 32 to the closed end. The regularly convoluted portion 34 includes a transitional section 34*a* immediately below the bottom of the upper sidewall means, an essentially cylindrical main section (or mid-section) 34*b* which typically constitutes a major portion (i.e., at least one-half) of the overall length of the liner 14, and an inwardly and downwardly tapered lower end section 34*c* which terminates in a tip 36, which is a blunted or rounded point, at the closed end of the liner 14.

The upper sidewall means 32 of liner 14 is devoid of pleats and comprises an outwardly turned frustoconical flange 38 surrounding the open end of the liner, a pair of concentric cylindrical sections 40 and 42, the former being of larger diameter than the latter and being disposed closer to the open end, and a frustoconical transition section 44 linking the cylindrical sections 40 and 42. Cylindrical section 42 is preferably of very short axial length and can be omitted entirely, so that frustoconical section 44 is adjacent to the upper end of the convoluted portion 34. The upper sidewall means 32 is a surface of revolution, the axis of which is the longitudinal axis of the liner 14.

The cylindrical section 40 of liner 14 may receive the lower portion of a conventional aerosol dispensing valve. The space enclosed by the neck 42 and the frustoconical transition section 44 is free space in an assembled dispensing container, and this space should be as small in volume as possible so as to minimize the amount of product which cannot be dispensed.

Figure 3:
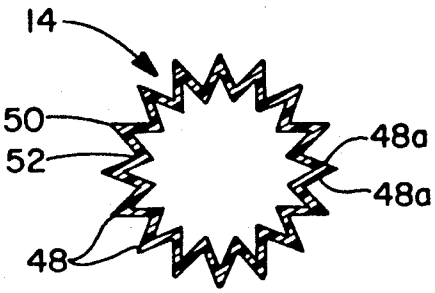
FIG. 3 is a cross-sectional view, taken along line 3—3 of FIG. 1, of a liner of this invention in its pleated state.

The convoluted portion 34 of liner 14 comprises a plurality of longitudinally pleats or convolutions, best seen in FIGS. 1 and 3. These pleats are formed by alternating longitudinally extending peaks 50 and valleys 52. The peaks and valleys are creased forming a permanent pleat. All peaks 50 have the same configuration and all valleys 52 have the same configuration, and each peak and valley lies in a longitudinally extending plane which passes through the axis of the liner. The peaks and valleys extend the entire length of convoluted portion 34, including the upper transition section 34*a*, the cylindrical mid section 34*b* and the inwardly tapered lower section 34*c*, and terminate at the tip 36 of liner 14. Each pleat or convolution 48 comprises a pair of longitudinally extending strip-like sidewall sections 48*a* (see FIG. 3) and the peak 50 included between these adjacent sidewall sections.

The peaks and valleys through the cylindrical mid-section 34*b* of convoluted portion 34 define a pair of concentric right circular cylinders. Thus, this mid section 34*b* is cylindrical and of uniform diameter. The peaks in the upper end section 34*a* of convoluted portion 34 taper toward the upper sidewall means 32. This aids in avoiding trapping of material to be dispensed in this region. The valleys may either taper or not in the upper end section 34*a* of the convoluted portion 34; in the preferred embodiment they do taper slightly since in this preferred embodiment the diameter of the neck 14 is less than that of the right circular cylinder formed by the valleys 50. FIG. 1 shows the lower portion 34*c* of the liner 14 in longitudinal section. This figure shows the contour of the sidewall of the liner 14 in this region, showing the inward taper of both the peaks 50 and the valleys 52 along arcuate paths from the cylindrical portion 34*b* of the liner to the tip 36 at the closed bottom end. This figure also shows that the thickness of the bottom wall of the liner 14, which forms tip 36, is substantially greater, in fact several times greater, than the thickness of the side wall which forms the convolutions 48. The bottom wall thickness at tip 36 is typically from about 0.1 to about 0.3 inch. (The bottom wall thickness is measured in the axial direction).

Figure 4:
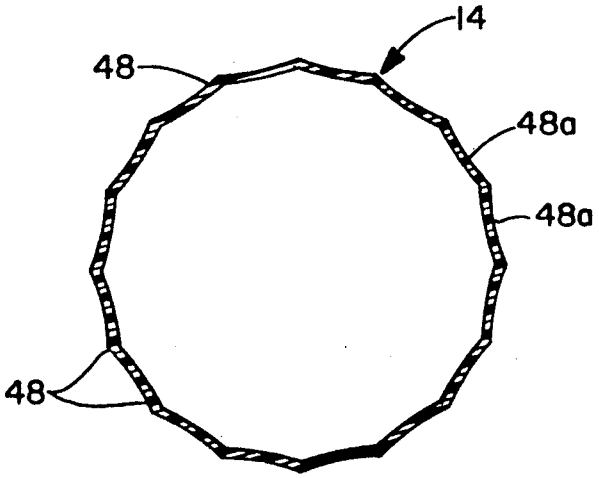
FIG. 4 is a cross-sectional view taken along line 4—4 of FIG. 2, of a liner of this invention in its expanded state.
Figure 2:
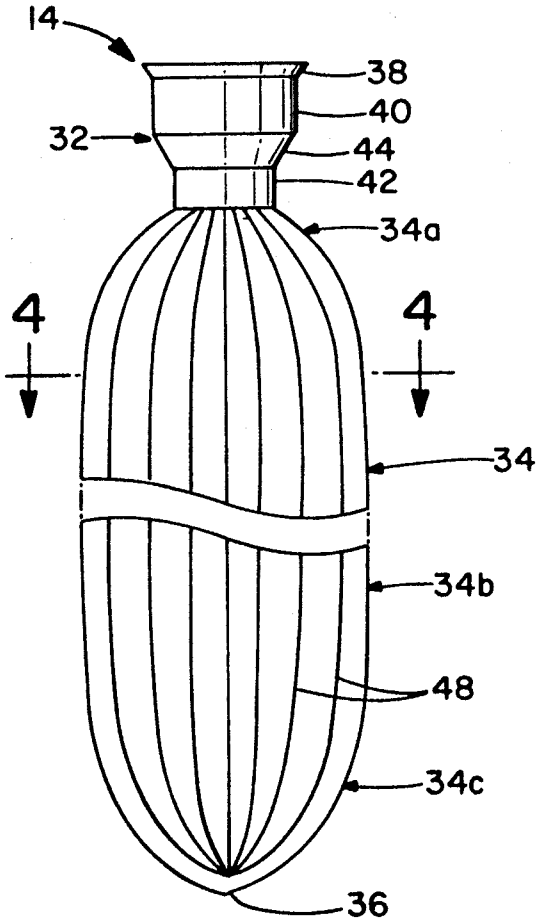
FIG. 2 is an elevational view of a liner according to this invention in its expanded state.

The contours of the peaks 50 and valleys 52 of the pleats or convolutions 48 when the liner 14 is in its normal or unstressed (i.e., non-pressurized) state may be seen in FIGS. 1 and 3. FIGS. 2 and 4 show the contours of pleats 48 when the liner 14 is in its expanded or pressurized state, i.e., when filled with product to be dispensed. In the expanded or pressurized state, the liner 14 expands until its cross-sectional shape is essentially that of a regular polygon as best seen in FIG. 4.

The depth of convolutions or pleats 48 is essentially uniform in the cylindrical middle part 34*b* of convoluted portion 34. The depth of the pleats 48 decreases at either end of the convoluted portion 34 as one approaches either the upper sidewall means 32 (at the upper end) or the tip 36 (at the lower end), and reaches zero at both the junction of the convoluted portion 34 with neck 42 and at the tip 36. There are no discernible folds or lines marking the boundaries between the cylindrical mid section 34*b* on the one hand in either the upper transition section 34*a* or the tapered lower section 34*c* of convoluted portion 34 of the liner 14.

The contour of each peak 50 and each valley 52 is a smooth line comprising a straight middle segment (corresponding to mid section 34*b*) and arcuate segments at either end (corresponding to transition section 34*a* and inwardly tapered section 34*c*).

Figure 5:
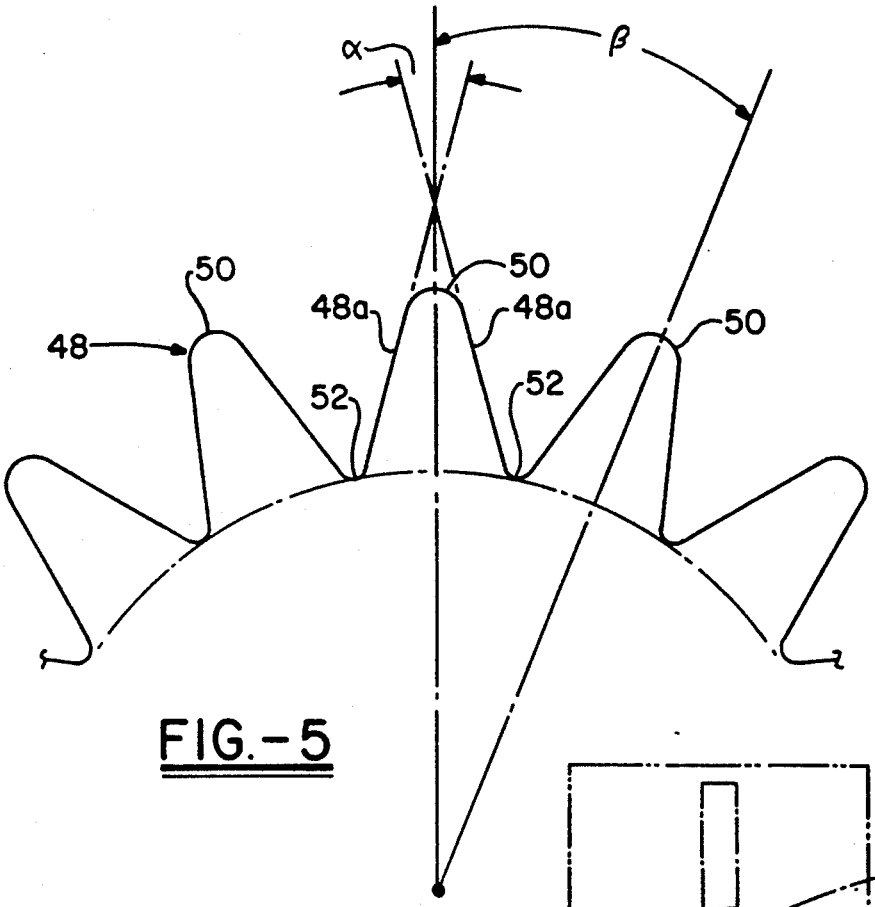
FIG. 5 is a cross-sectional view on an enlarged scale, of the profile or trace of a portion of the outside surface of the liner, showing the configuration of the convolutions or pleats in detail.

FIG. 5 shows in greater detail, on an enlarged scale, the configuration of convolutions or pleats 48 in the mid section 34*b* of a liner 14 in the unstressed state. This view is similar to that shown in FIG. 3 except that it shows a trace of only the outside surface of the sidewall of liner 14 and shows only a portion of the circumference of the liner. This view represents the preferred configuration of the convolutions or pleats 48 of a liner having a nominal capacity of 8 ounces (227 grams) when filled. (The actual capacity of an 8 ounce liner may be somewhat larger, e.g., 280 grams). As may be seen in FIG. 5, each convolution or pleat 48 comprises a pair of intersecting longitudinally extending strip-like portions 48*a* of the sidewall of liner 14. These two adjacent side wall portions 48*a* are disposed at an acute angle $\alpha$ (alpha), preferably 30°, with respect to each other. Preferably the peaks 50 are slightly rounded so that adjacent sidewall portions 48*a* do not actually intersect. The apex angle of a pleat 48, i.e., the angle $\alpha$ between the two adjacent sidewall portions 48*a* forming a single pleat, is an acute angle and in the preferred embodiment is 30°. This represents the angle between these sidewall portions in the liner 14 as formed.

The valleys 52 occur at the intersection of two adjacent pleats, also as shown in FIG. 5.

A liner 14 according to this invention is always formed in pleated form, as shown in FIG. 1,3 and 5. The apex angle $\alpha$ of a pleat may be larger than the 30° shown in FIG. 5; however this apex angle should never exceed 90° and should never exceed 70°, in order to obtain efficient and substantially complete expulsion of the product which is contained in liner 14 when filled.

Applicant has found that the number of pleats 48 in a liner 14 should be from about 12 to 20. The angular spacing $\beta$ (beta), shown in FIG. 5, is equal to 360° divided by the number of pleats. In the preferred liner shown, there are 16 such pleats 48, and they are evenly spaced 22.5° apart, measured from the center line of one convolution or pleat to the centerline of the next convolution or pleat. These center lines extend through the peaks 50.

Figure 6:
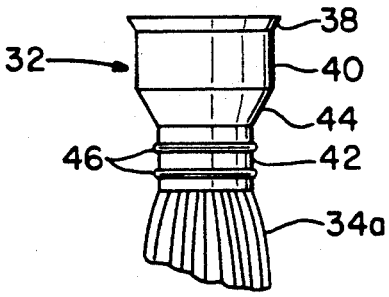
FIG. 6 is a fragmentary elevational view of the upper portion or upper sidewall means of a liner of this invention according to an alternative embodiment.

Also may be seen in FIG. 6 the valleys 52 are slightly rounded. Typically the radius of the valleys is less than that of the peaks 50. In any given liner, all valleys 52 will have the same radius and all peaks 50 will have the same radius. Since both the peaks and the valleys are sharply creased, the respective radii are quite small. The radius of curvature of the peaks 50 is not over about 0.05 inch and is typically about 0.03 inch.

A liner 14 is preferably formed by extrusion blow molding, of which more will be said later. As will be apparent to those skilled in the art, the shape of the mold cavity wall in which a liner is formed will be the same as the shape of the outside surface of the liner sidewall. Hence FIG. 5 also represents the trace or contour of the mold cavity wall, taken along a horizontal section plane, e.g., 2—2 of FIG. 1. The dimensions of the mold cavity are slightly larger than those of the desired liner 14, since a slight amount of shrinkage takes place as is well known in the art.

While the mid section 34*b* of convoluted portion 34 as shown is generally of cylindrical configuration, it may assume other configurations, e.g., ellipsoidal or spherical. In particular, the mid section 34*b* of convoluted portion 34 may be barrel shaped, i.e., ellipsoidal wherein the outside diameter of the liner, measured from a peak 50 to a diametrically opposite peak, is only slightly larger at the center of this mid section than it is at the upper and lower ends thereof. In any case, the preferred configurations are surfaces of revolution, and in all cases the convoluted portion has regular longitudinally extending convolutions, which are permanent pleats.

Liner 14 is made of a flexible plastic material, which may be either elastomeric or non-elastomeric, preferably non-elastomeric. A preferred material is high density polyethylene (HDPE); other suitable materials include polyamide and "Barex" 218, which is an acrylonitrile available from British Petroleum. The liner can be formed of two or more materials by co-extrusion blow molding if desired. It is not necessary or desirable to form any additional layers on the liner once it has been discharged from the mold. Liner 14 is flexible over its entire length, except that it is typically quite stiff near tip 36, but is stiff enough over its entire length to be self-supporting.

The liner may be of any suitable thickness, typically about 10 to 20 mils (0.010 to 0.020 inch) average sidewall thickness, preferably about 0.012 to 0.018 inch, over substantially its entire length except optionally at the tip 36 and at the neck 42. The upper sidewall means 32 is of substantially uniform thickness of about 10 to about 20 mils over its entire length, except that the neck 42 may be slightly thicker. Except for the tapered portion near tip 36, the convoluted portion 34 of the liner should also be of substantially uniform thickness, in a range of about 10 to about 20 mils over its entire length. Minor variations in thickness at any given horizontal cross-sectional plane in the convoluted portion are acceptable. Thus, the sidewall thickness of liner 14 at the peaks 50 may range from about 0.010 to about 0.020 inches while the sidewall thickness at the valleys 52 is typically somewhat greater, e.g., about 0.022 to about 0.026 inch. The bottom wall of the liner 14 at tip 36 is typically much thicker, e.g., from about 0.1 to about 0.3 inch (preferably approximately 0.175 inch) so that the liner can be inserted into a elastomeric sleeve with the aid of mandrel without puncturing the bottom end wall.

The liner 14 is radially expandable by virtue of its folds or convolutions 48, even when it is made of a non-elastomeric material. (Radial expansion and contraction occurs primarily in the mid part 34*b* of convoluted portion 34). Liner 14 is substantially inextensible in the longitudinal direction. A non-elastomeric liner having the thickness stated above is inherently flexible;

for example, the mid section 34*b* can be flexed or bent by hand. It is also inherently compressible; the mid-section 34*b* can be squeezed in the radial direction by finger pressure applied by a person between the thumb and forefinger. At the same time, this thickness is sufficient so that the liner is self-supporting, i.e.. capable of holding the folded or convoluted shape shown in FIGS. 1 and 3 of the drawings when not under pressure and (because the plastic material forming the liner has memory) returning to that shape when stressed is removed.

When fluid under pressure is introduced into the liner 14, it expands, assuming the configuration shown in FIGS. 2 and 4. The circumference or perimeter of the liner in its expanded form is nearly circular (actually polygonal) as may be seen in FIG. 4.

The drawings herein are not necessarily to scale, for example, FIG. 4 is drawn to a larger scale than FIG. 3. Also, wall thicknesses of liner 14 have been exaggerated for the sake of clarity.

An alternative neck design is shown in FIG. 6. The neck 42 in this embodiment is slightly longer in the axial direction than its counterpart in FIG. 1, and beads 46 encircling the neck are provided as an aid in gripping the upper end of the elastomeric sleeve 16. However, it has been found that such gripping beads are not necessary. The grip between the upper end of the sleeve 16 and the liner 14 is fully satisfactory whether or not such beads are present.

The liner may be formed by conventional plastic molding techniques, preferably by extrusion blow molding. The liner is molded in its pleated or folded form as shown in FIGS. 1, 3 and 5. Since the material forming the liner has memory, the liner will return to the folded form shown in FIG. 1 when no pressure or other stress is applied. This is important in order that the liner will have maximum effectiveness in expelling substantially the entire quantity of product contained in liner 14.

A liner 14 of this invention is especially designed and intended for use in a non-aerosol dispensing container such as that shown in and described in applicant's copending parent application Ser. No. 07/646,621, filed Jan. 28, 1991, now allowed. For the convenience of the reader, a dispensing container of the non-aerosol type employing a liner 14 of this invention will be described briefly with reference to FIG. 7. For further details the reader is referred to applicant's parent application Ser. No. 07/646,621.

Figure 7:
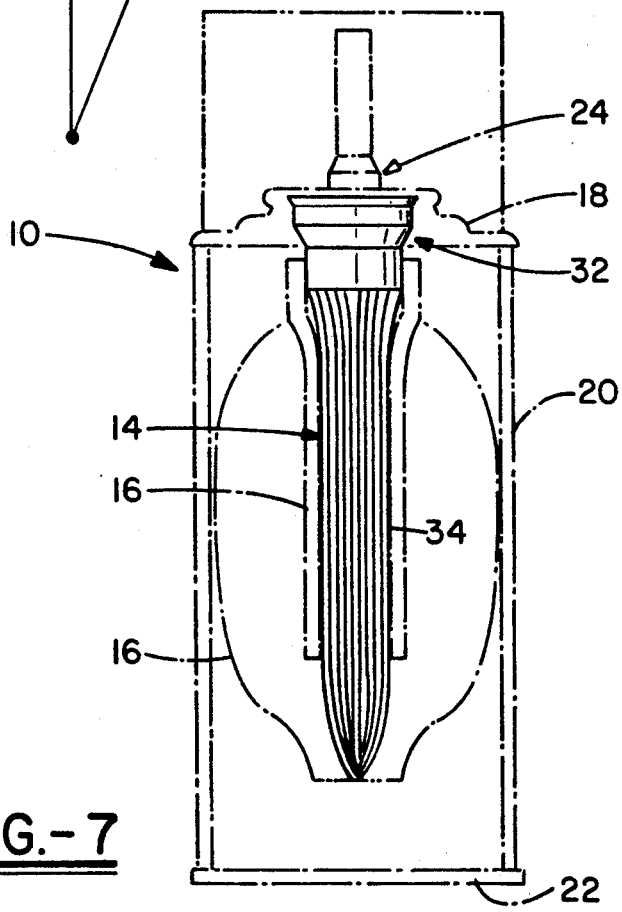
FIG. 7 is an elevational view of a complete container assembly including a liner according to this invention, an elastomeric sleeve, a dome housing and valve, wherein all parts except the liner are shown in phantom lines.

Referring now to FIG. 7, 10 is a non-aerosol dispensing container which may be in accordance with applicant's parent application Ser. No. 07/646,621. Non-aerosol dispensing container 10 comprises a liner 14 as has been described, surrounded in part (i.e., from the neck 42 down to the lower end of the midsection 34*b* of the convoluted portion 34, by an elastomeric sleeve 16 whose inside diameter in the unstressed state is appreciably less than the outside diameter of liner 14 (measured between two diametrically opposite peaks 50 in the cylindrical mid-section 34*b* of convoluted portion 34). Thus the elastomeric sleeve compresses the liner 14 so that adjacent sidewall portions 48*a* are in touching engagement and parallel to each other, so that there is very little void space inside the liner 14. This state of the liner may be referred to as the compressed state. In this compressed state the volume of the liner is typically only about 5% (and in no case more than about 10%) of the volume of the liner in the expanded state shown in FIGS. 2 and 4. In fact, the volume of the liner in the compressed state is substantially less than in the unstressed state shown in FIGS. 1 and 3. The container also includes a housing which comprises an annular dome 18, a cylindrical sidewall or outside shell 20 and a bottom wall 22; and a valve assembly 24.

FIG. 7 shows the container 10 when the liner 14 and sleeve 16 are in their normal position, i.e., when liner 14 is empty. When liner 14 is pressurized and filed with product to be dispensed, it assumes the configuration shown in FIGS. 2 and 4 and the surrounding sleeve 16 assumes the contour shown in phantom line in FIG. 7.

The annular dome 18 and the dispensing valve 24 may be similar or identical to their counter-parts in a conventional aerosol container. The inside diameter of the upper cylindrical section 40 is just slightly greater than 1 inch to accommodate a conventional aerosol dispensing valve.

A liner 14 in its unstressed state, as shown in FIG. 1, may be inserted into a sleeve 16, also in a its unstressed state, to form a liner/sleeve assembly as shown in FIG. 7. Such insertion may be accomplished with the aid of a mandrel, typically a steel rod having a hemispherical forward end. The thickness of the bottom end wall of the liner 14 (at tips 36) is sufficient so that the mandrel will not puncture the liner. A lubricant may be applied to either the outside surface of the liner or the inside surface of the sleeve to facilitate insertion. Alternatively, a lubricant additive may be added in the compound forming the sleeve 16.

Formation of the liner 14 in the convoluted or pleated state, as shown in FIGS. 1, 3 and 5, and use of the V-shaped pleat configuration which is particularly evident in FIG. 5, result in a liner which can be compressed by the elastomeric sleeve (or energy tube) 16 to a state wherein the pleats 48 lie flat one against another so there is very little dead space inside the liner, resulting in a liner from which virtually all product can be dispensed. Expulsion of product from non-aerosol containers employing liners in accordance with this invention is substantially complete, while appreciable quantities of product remain in previously known self-pressurized containers, employing liners of other configurations when the container has been emptied as far as possible.

Liners 14 of this invention can be made in any convenient size ranging from about 2 ounces (about 57 grams) to about 16 ounces (about 454 grams). These capacities refer to the volume when filled, i.e., in the expanded state shown in FIGS. 2 and 4. A particularly suitable size for a variety of purposes is 8 ounces (227 grams) nominal capacity in the expanded state. (The actual capacity may be slightly larger, e.g., about 280 grams).

Dimensions of two representative 8 ounce liners of this invention, designated A and B, respectively, will be shown in the table below. Liner A is a particularly preferred liner which is formed in the convoluted state with a small apex angle (30°) as measured at a peak 50. Liner B is also formed in the convoluted state, but somewhat flatter than liner A, i.e., with a wider apex angle (67°). The apex angle refers to the angle between two adjacent sidewall sections 48*a* forming a convolution or pleat 48. The apex angle is the angle at a peak 50. The liner B may be somewhat easier to mold by extrusion blow molding techniques than liner A because the wider apex angle; however, it has not been demonstrated to be as efficient in expelling product with very little waste, and one can expect some tradeoff between these two characteristics.

Representative dimensions are shown in the table below:

TABLE

| Liner | A | B |
|---|---|---|
| Overall length, inches | 7.29 | 7.29 |
| Length of midsection 34b, in. | 3.75 | 3.75 |
| Outside diameter at midsection, in. | 1.19 | 1.66 |
| Inside diameter at midsection, in. | 0.83 | 1.35 |
| Outside diameter, filled, inches | 2.20 | 2.20 |
| Number of pleats | 16 | 16 |
| Pleat apex angle | 30° | 67° |

In the Table above, "outside diameter" refers to the diameter of a cylinder tangent to peaks 50, and "inside diameter" refers to the diameter of a cylinder tangent to the valleys 52.

While this invention has been described with reference to the best mode and preferred embodiment thereof, it is understood that this description is by way of illustration and not by way of limitation.

What is claimed is:

1. An elongated radially expandable and longitudinally essentially inextensible generally cylindrical flexible plastic liner having an open end, a closed end, and a sidewall extending from said open end to said closed end;

said sidewall comprising an upper sidewall, an essentially cylindrical mid-section and a tapered lower portion which terminates in a tip at said closed end;

said upper sidewall including an externally turned flange at said open end and a neck section below said flange;

said mid-section and said tapered lower portion of said sidewall comprising a plurality of longitudinally extending sidewall sections arranged in side-by-side relationship, wherein adjacent sidewall sections intersect forming alternating longitudinally extending peaks and valleys, the angle of intersection at said peaks being an acute angle not exceeding about 70° when said liner is in the unstressed state;

said liner having sufficient thickness to be self supporting in the unstressed state, the upper sidewall and the mid-section of said sidewall having an essentially uniform average thickness in the range of about 0.010 inch to about 0.020 inch;

the thickness of the liner in the axial direction at the tip being sufficient to withstand the force of a mandrel used to insert said liner into an elastomeric sleeve, said thickness being from about 0.1 to about 0.3 inch;

said liner being formed of a plastic material which has memory and being formed in the folded state wherein said peaks and valleys are present, whereby said liner returns to the folded state when unstressed.

2. A liner according to claim 1 wherein said acute angle is not in excess of about 45°.

3. A liner according to claim 1 further including a transition section between said mid-section and said upper sidewall.

4. A liner according to claim 3 wherein the contour of each of said peaks and valleys in the longitudinal direction is a smooth continuous line comprising a straight middle segment and outer segments on either side thereof, the straight middle segment being disposed in said mid-section of the liner and the outer segments being disposed in said transition section and said inwardly tapered lower section of the liner.

5. A liner according to claim 1 wherein the angle of intersection at said peaks is about 30°.

6. A liner according to claim 1, said liner having from 12 to 20 peaks and from 12 to 20 valleys.

* * * * *